United States Patent [19]

Eguchi et al.

[11] 4,409,915

[45] Oct. 18, 1983

[54] SWITCH CONTROL METHOD OF AN ELECTRONIC SEWING MACHINE

[75] Inventors: Yasukata Eguchi, Kinitachi; Susumu Hanyu; Hideaki Takenoya, both of Hachioji; Mikio Inamori, Hino, all of Japan

[73] Assignee: Janome Sewing Machine Co., Ltd., Tokyo, Japan

[21] Appl. No.: 351,740

[22] Filed: Feb. 24, 1982

[30] Foreign Application Priority Data

Mar. 20, 1981 [JP] Japan ..... 56-39515

[51] Int. Cl.[3] ..... D05B 3/02

[52] U.S. Cl. ..... 112/266.1; 112/158 E

[58] Field of Search ..... 112/158 E, 121.11, 121.12, 112/262.1, 266.1

[56] References Cited

U.S. PATENT DOCUMENTS 4,144,827 3/1979 Brown ..... 112/158 E 4,373,459 2/1983 Dunn et al. ..... 112/158 E

*Primary Examiner*—Peter P. Nerbun

*Attorney, Agent, or Firm*—Michael J. Striker

[57] ABSTRACT

A method is disclosed for modifying a specific stitch or stitches of a given stitch pattern while the other parts of the pattern remain subject to the standard setting specific to the pattern.

1 Claim, 4 Drawing Figures

(1). Start (2). Initial setting (3). Reading key
(4). Pattern selection (5). Reading ROM
(6). Final code (7). Needle position adjusting manual ON
(8). First bit 1 (9). Reading reduction rate
(10). Needle position control data multiplied by reductin rate
(11). Change by adjustment (12). Needle position control phase
(13). Needle position control output (14). Feed adjusting manual ON (15). Second bit 1 (16). Reading reduction rate
(17). Feed control data multiplied by reduction rate
(18). Feed control phase (19). Feed control output
(20). Controller OFF (21). Needle position control phase

FIG_4

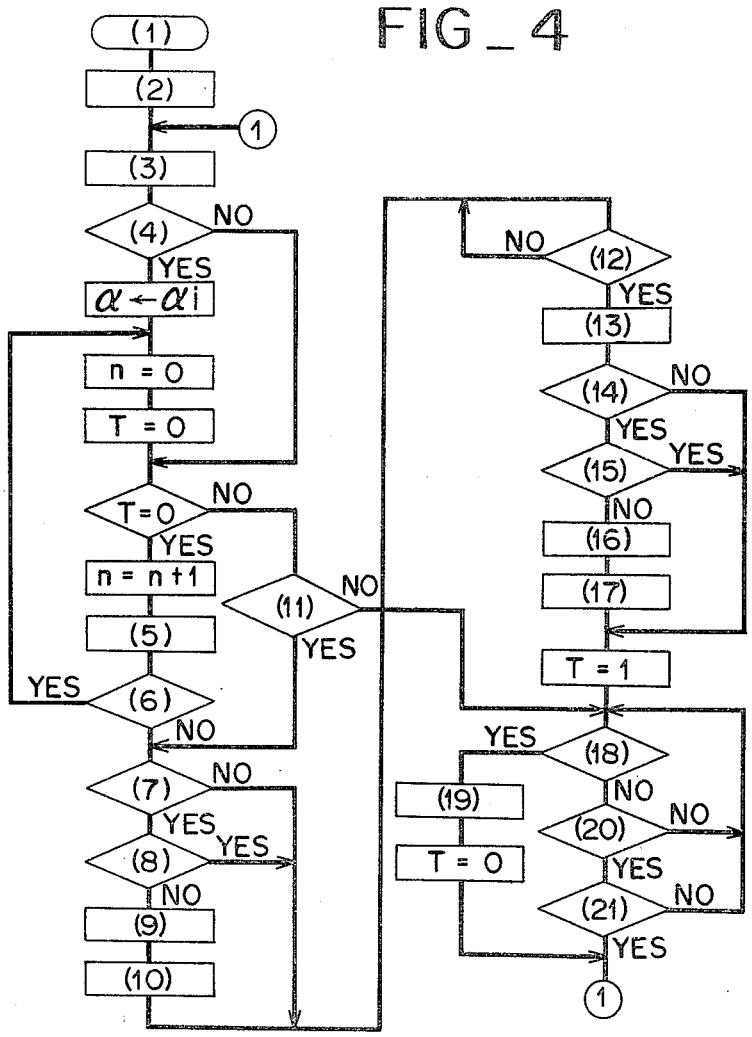

(1). Start (2). Initial setting (3). Reading key
(4). Pattern selection (5). Reading ROM
(6). Final code (7). Needle position adjusting manual ON
(8). First bit 1 (9). Reading reduction rate
(10). Needle position control data multiplied by reductin rate
(11). Change by adjustment (12). Needle position control phase
(13). Needle position control output (14). Feed adjusting manual ON (15). Second bit 1 (16). Reading reduction rate
(17). Feed control data multiplied by reduction rate
(18). Feed control phase (19). Feed control output
(20). Controller OFF (21). Needle position control phase

SWITCH CONTROL METHOD OF AN ELECTRONIC SEWING MACHINE

BRIEF DESCRIPTION OF THE INVENTION

The invention relats to an electronic sewing machine, and more particularly relates to a stitch control method of an electronic sewing machine having a microcomputer including an electronic memory which stores stitch control signals to be used in a program control of the sewing machine to drive the control motors for controlling the stitch forming devices of sewing machine. According to the invention, the microcomputer discriminates the presence of a stitch adjusting signal from a stitch adjusting device to be effective or noneffective with respect to each stitch control signals so as to modify only a required part of the pattern while the other parts of the stitch pattern remain to be subject to the standard setting specific to the pattern.

According to the conventional art, the pattern cams bear the stitch control signals which are mechanically transmitted to the stitch forming device of sewing machine, and therefore the adjustment of stitches has been made by changing the transmission rate of the intermediate transmission mechanism. As the result, the stitch control signals are all inavoidably modified at a fixed common rate of the stitch adjusting device, and the resultant stitch pattern is destined to be a wholly narrower or wider one, and it has been impossible to partly modify a selected pattern. Even with an electronic sewing machine having a memory which stores the stitch control data, the stitch adjustment has been made commonly to the relation rate between the stitch control data and the mechanical movement, and it has been impossible to partly modify the stitches of a pattern. In any events, the function of stitch adjusting device has been strictly limited in the prior art.

The present invention has been provided to eliminate the defects and disadvantages of the prior art.

It is a primary object of the invention to provide a stitch control method of an electronic sewing machine to modify only a specific stitch or stitches of the stitches forming a predetermined pattern at a predetermined reduction or enlargement rate by operation of a stitch adjusting device in dependence upon the thickness, the kind of fabric to be sewn or in dependence upon the part of fabric to be sewn.

It is another aspect of the invention to increase the effect of stitches forming a repeatedly produced predetermined pattern with respect to a fabric to be sewn by partly modifying the stitches of the pattern by operation of a stitch adjusting device.

BRIEF DESCRIPTION OF THE DRAWINGS

FIG. 4 is a control flow of the invention.

DETAIL DESCRIPTION OF THE INVENTION

Figure 1:
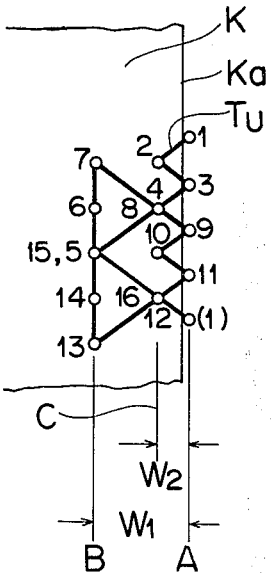
FIG. 1 is a plan view of a series of stitches forming a pattern specifically shown in relation to the invention.
Figure 2:
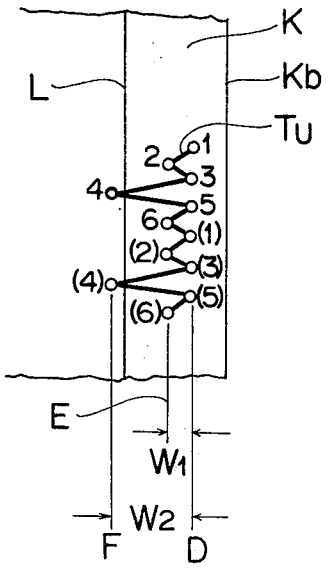
FIG. 2 is a plan view of a series of stitches forming another pattern specifically shown in relation to the invention.
Figure 3:
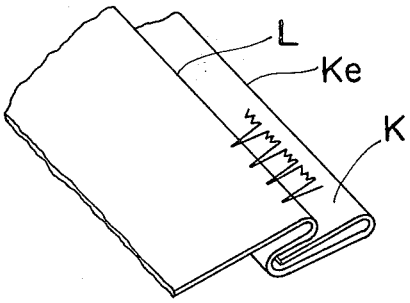
FIG. 3 is an oblique view of the pattern stitches of FIG. 2.

In reference to FIGS. 1–3, K denotes a fabric to be sewn. Ka and Kb denote an edge of the fabric. L denotes a fold of the fabric K. Marks (°) denote needle dropping points, and the numbers attached to the marks denote the stitches. The needle dropping points are connected to each other in the sequence of the numbers by the upper thread Tu of sewing machine. The formation of the stitches shown in FIG. 1 is described in detail in the Japanese patent application 56-4994 and in the carresponding U.S. patent application of the same applicant. A series of stitches 1, 3, 9, 11 . . . are located on a line A slightly outside of the fabric edge Ka to prevent the fabric edge from fraying. The stitches 1, 3, 9, 11 . . . function as the overlock stitches together with a series of stitches 5, 6, 7, 13 . . . located on a line B inside sufficiently of the fabric edge Ka. The width $W_1$ between the lines A and B is normally constant and is not adjustable. The series of stitches 5, 6, 7, 13 . . . on the line B are usually employed to sew up two pieces of fabrics together. On the other hand, the stitches 2, 4, 8, 10 . . . are produced on a line C which is located between and in parallel with the lines A and B with a width $W_2$ between the lines A and C which is considerably smaller than the width $W_1$. Thus the stitches 2, 4, 8, 10 . . . are produced to consolidate the overlock stitching function of the stitches 1, 3, 9, 11 . . . and 5, 6, 7, 13 . . . .

Now it is preferred to adjust such stitches in FIG. 1 in accordance to the thickness, the kind and the condition of edge of the fabric to be sewn. Especially it is preferred to variably adjust the width $W_2$ while the width $W_1$ is unchanged. Practically there will be no adverse influence in a slight change of width $W_1$ in accordance with the adjustment of the width $W_2$. It is, however, not preferable to change the width $W_1$ in proportion to the adjustment of the width $W_2$ which is considerably smaller than the width $W_1$.

FIGS. 2 and 3 show the stitches generally known as the stretch blind stitches usually suitable for stitching the three folded fabric as shown in FIG. 3 especially to give an elasticity to the folded part of the fabric by the stitches of width $W'_1$ between the lines D and E. The width $W_1$ requires more than a minimum permissible value to give a suitable elasticity to the folded part of the fabric, and requires no adjustment. On the other hand, the stitches on the line F are produced to fixedly position the fold L of the fabric K, and the stitch width $W'_2$ between the lines D and F requires a proper adjustment in accordance with the thickness and the kind of the fabric to be sewn. It is not preferable that the width $W'_1$ is changed in accordance with the adjustment of the width $W'_2$.

FIG. 4 shows a control flow chart of the invention which is programmingly controlled by a microcomputer installed in a sewing machine. The microcomputer includes an electronic memory (ROM) storing needle position control data and feed movement control data each in match with a detecting signal indicating the data adjustable or nonadjustable for producing, for example, the stitch pattern such as shown in FIG. 1. The detecting signal is of 2 bits. Each stitch control data with a detecting signal 0 0 is subject to the adjusting amount designated by a stitch adjusting device. Each stitch control data with a detecting signal 0 1 is subject to the needle position adjustment designated by the stitch adjusting device. Each stitch control data with a detecting signal 1 0 is subject to the feeding adjustment designated by the stitch adjusting device. Each stitch control data with a detecting signal 1 1 is beyond the control of the stitch adjusting device. The needle position control data 0 corresponds to the right end position of maximum swinging range of needle. The needle position control data 3 0 corresponds to the left end position of maximum swinging range of needle. The feed control data 0 corresponds to the maximum feeding in the backward direction. The feed control data 15 corresponds to non-feeding in either direction, and the feed control data 30 corresponds to the maximum feeding in the forward direction.

The invention will be described in reference to FIG. 4:

A control power source is applied, the microcomputer is operated to start a programming control. As the initial setting before a pattern is selected, the straight stitching is designated to a register $\alpha$. Then the microcomputer reads a pattern selecting key and another key indicating if a manual operating device is designated for adjusting the needle position and the feeding movement. If such a designation is not given, an automatic function is designated for setting the standard stitches for a selected pattern. As to reading the keys immediately after the control power source is applied, the absence of pattern selecting operation is regarded as equivalent to a selection of the straight stitching, and the subsequent control is performed. In response to operation of a pattern selecting key, a designation signal of the straight stitching or a selected stitch pattern is memorized in the register $\alpha$. In this case, it is provided that operation has been made to select the pattern as shown in FIG. 1 when the sewing machine is standstill, and the pattern has been memorized as $\alpha_1$ ($\alpha_1$, $\alpha_2$ . . . are shown as $\alpha_1$ in FIG. 4).

Then the address n for sequentially reading out the stitch control data of a selected pattern are changed to 0 to repeatedly producing the same pattern. Subsequently a flag T is reset to 0 to make effective the function for advancing the addresses n by way of the following calculations. Since T is 0, that is, T=0, the addresses n is advanced from 0 to 1. The stitch control data corresponding to the address 0 is represented by a stitch 1 as shown, and the needle position control data is 0, the feed control data is 22 and the detecting signal is 1 0. The needle position control data 0 produces the stitch 1 in FIG. 1, and the feed control data 22 produces the fabric feeding amount from the stitch 1 to the next stitch 2. In the subsequent control when the manual adjustment is designated to the needle position or to the feed movement, the detecting signal 1 0 makes effective such a designated adjustment of the feed movement, but nullifies such a designated adjustment of the needle position and controls the needle position with the fixed standard values specific to the pattern. Namely if the manual needle position adjustment is ON, the first bit of the detecting signal is discriminated. Since this is 1, no adjustment is made to the needle position control data 0, and the needle position control motor is driven at the needle position control phase of sewing machine. On the other hand, if the manual feeding adjustment is ON, the other bit of the detecting signal is discriminated. Since this is 0, the reduction rate by the manual feeding adjustment is read out, and the difference between the feed control data 22 and the feeding data 15, that is, the divergence 7 from the feeding amount 0 is multiplied by the reduction rate by the manual feed adjustment. Thus the calculated result T=1 is obtained, with which to drive the feed control motor at the feed control phase of the sewing machine.

Then T is made 0, that is, T=0 and the program flow comes to a return point (1). In this case, if the feed control phase is not provided while the machine drive controller is not operated (OFF), T=1 remains unchanged and the program flow will not come to advance the address n, and waits for the coming of the feed control phase. As mentioned, if the feed control motor is driven and the program flow comes to the return point (1), the address is advanced to 2 and the data is read out for the stitch 1. This detecting signal is 0 0, and therefore the needle position data 6 is multiplied by the reduction rate by the manual adjustment to drive the needle position control motor at the needle position control phase of the sewing machine. In the same way, the feed control data 7 is multiplied by the reduction rate by the manual adjustment to drive the feed control motor at the feed control phase of sewing machine. Subsequently the address is advanced in the same way. When the address n becomes 17, that is n=17, indicating the final code of the pattern (the needle position control data 31 for example), the address n is returned to 0, that is n=0, and the same stitch pattern is repeatedly produced.

According to this embodiment, the change by the manual adjustment of the needle position and the feed movement is accepted when the machine drive controller is OFF and at the needle position control phase of the sewing machine. Namely when T becomes 1, that is, T=1 after the needle position control is issued at the needle position control phase at the time of pattern selection, the program flow recognizes such a change through the return point 1 to produce the needle position control output with the modification in accordance to the change, and then the reduction rate by the manual adjustment is employed at the feed control phase after the machine drive controller is ON.

What is claimed is:

1. A stitch control method by use of an electronic sewing machine having a microcomputer including an electronic memory storing stitch control data to operate the stitch forming device of the sewing machine for producing stitches, said method comprising; providing a stitch adjusting means for adjusting at least one of the needle position and the fabric feeding movement; providing discriminating signals each in match with each of the stitch control data stored in the electronic memory for discriminating the designation of the stitch adjusting means to be effective or noneffective; operating the microcomputer to read out the stitch control data from the electronic memory at a predetermined rotation phase of the sewing machine to make a calculation by means of the discriminating signal and the adjustment signal of the stitch adjusting means so as to modify the stitch control data designated by the discriminating signal for adjusting the corresponding stitch, the result of the calculation operating the stitch forming device at a predetermined rotation phase of the sewing machine.

* * * * *